US005145326A

United States Patent [19]

Kimura et al.

[11] Patent Number: 5,145,326

[45] Date of Patent: Sep. 8, 1992

[54] VARIABLE CAPACITY WOBBLE PLATE TYPE COMPRESSOR WITH CAPACITY REGULATING VALVE

[75] Inventors: Kazuya Kimura; Kenji Takenaka, both of Kariya, Japan

[73] Assignee: Kabushiki Kaisha Toyoda Jidoshokki Seisakusho, Aichi, Japan

[21] Appl. No.: 537,434

[22] Filed: Jun. 13, 1990

[30] Foreign Application Priority Data

Jun. 16, 1989 [JP] Japan ..... 1-155541

[51] Int. Cl.[5] ..... F04B 1/28

[52] U.S. Cl. ..... 417/222.2; 417/270; 417/222.1

[58] Field of Search ..... 417/222 S, 269, , 269, 417/270, 222

[56] References Cited

U.S. PATENT DOCUMENTS

| | | | |
|---|---|---|---|
| 4,606,705 | 8/1986 | Parekm | 417/222 S |
| 4,685,866 | 8/1987 | Takenaka | 417/222 S |
| 4,687,419 | 8/1987 | Suzuki | 417/222 S |
| 4,702,677 | 10/1987 | Takenaka et al. . | |
| 4,723,891 | 2/1988 | Takenaka | 417/222 S |
| 4,730,986 | 3/1988 | Kayukawa et al. . | |
| 4,737,079 | 4/1988 | Kurosawa | 417/222 |
| 4,875,832 | 10/1989 | Suzuki | 417/222 S |

FOREIGN PATENT DOCUMENTS

| | | | |
|---|---|---|---|
| 0220798 | 9/1985 | European Pat. Off. | 417/222 S |
| 63-16177 | 1/1988 | Japan . | |

*Primary Examiner*—Richard A. Bertsch
*Assistant Examiner*—Peter Korytnyk
*Attorney, Agent, or Firm*—Burgess, Ryan & Wayne

[57] ABSTRACT

A variable capacity wobble plate type compressor with a variable angle non-rotary wobble plate, having a suction chamber for refrigerant gas before compression, a discharge chamber for a refrigerant gas after compression, a crankcase defining a crank chamber to receive therein a drive and a wobble plate mechanism mounted about a drive shaft connectable to a drive source, i.e., a car engine, operatively connected to compressing pistons reciprocatorily movable in cylinder bores to cause compressing motions and capable of changing the wobble angle thereof in response to a difference between pressures in the crank and the suction chambers, a gas supply passageway providing a communication between the discharge chamber and the crank chamber, a gas evacuation passageway providing a communication between the crank chamber and the suction chamber, a capacity regulating valve arranged in the gas supply passageway to regulate an opening and closing of the communication between the discharge and the crank chambers in response to a change in one of pressures in the crank chamber, the suction chamber, and the discharge chamber with respect to a given set pressure value, and an external control unit capable of changing the given set pressure value in response to an externally applied signal.

2 Claims, 6 Drawing Sheets

VARIABLE CAPACITY WOBBLE PLATE TYPE COMPRESSOR WITH CAPACITY REGULATING VALVE

BACKGROUND OF THE INVENTION

1. Field of the Invention

The present invention relates to a variable capacity wobble plate type compressor used, not exclusively but preferably, for air-conditioning a car compartment, and more particularly, to a variable capacity wobble plate type compressor provided with a pressure-responsive piston drive mechanism including a variable angle non-rotary wobble plate, and a capacity regulating valve for regulating a compressor capacity by controlling a pressure level in a crankcase in which the piston drive mechanism is received.

2. Description of the Related Art

U.S. Pat. No. 4,730,986 to Kayukawa et al discloses a variable capacity wobble plate type compressor having a wobble angle control valve controlling the compressor capacity in response to a change in a cooling load. The wobble angle control valve comprises two valves; one for controlling a supply of a high pressure gas into a crankcase in which a pressure-sensitive piston drive mechanism is received, and the other for controlling the evacuation of a blowby gas from the crankcase. Namely, the variable displacement wobble plate type compressor of U.S. Pat. No. 4,730,986 is provided with a variable angle non-rotary wobble plate; a suction chamber for refrigerant before compression; a discharge chamber for refrigerant after compression; suction, compression and discharge cylinder bores; pistons reciprocated by the wobble plate within the cylinder bores for compressing the refrigerant; a crankcase with a crank chamber receiving therein a pressure-responsive piston drive mechanism including a wobble plate mounted about a drive shaft connectable to a rotary drive source; a first communication passageway permitting an adjustable supply of a high pressure gas from the discharge chamber into the crankcase chamber; a first control valve for closing and opening the first passageway in response to a change in a fluid pressure indicative of a refrigerating load change; a second communication passageway for permitting an adjustable evacuation of a blowby gas from the crankcase chamber to the suction chamber; and a second control valve changing an extent of an opening of the second communication passageway in response to an electrical signal or signals indicating a change in a physical value relative to the air-conditioning circuit and the vehicle, as well as in response to a change in a fluid pressure level in the crankcase chamber. Nevertheless, the above-mentioned first control valve does not include a means capable of adjustably changing a reference value, with respect to which a fluid pressure change causes an operation of the first control valve to adjustably open and close the first communicating passageway for supplying the high pressure gas, and therefore, the control operation of the first control valve is not satisfactory from the view point of the capability thereof to respond to an extremely large change in a cooling load of an air-conditioning circuit. The second control valve is able to assist the obtaining of an accurate operation of the first control valve, but is unable to broaden the capability of the response characteristic of the first control valve.

Japanese Unexamined (Kokai) Patent Publication No. 63-16177 discloses another variable capacity wobble plate type compressor having a capacity control valve. The compressor of the JP-A-63-16177 includes a crank chamber defined by a crankcase; a drive shaft extended in the crank chamber and rotatably supported by the crankcase; a rotary member fixedly mounted on the rotatable drive shaft; a rotary drive member mounted around the drive shaft and pivoted on the rotary member via a hinge mechanism, to change an angle of inclination with respect to the drive shaft; a wobble plate non-rotatably mounted on an inclining surface of the rotary drive plate and performing a wobbling motion in response to a rotation of the drive shaft; a plurality of pistons connected to the wobble plate to reciprocate in corresponding cylinder bores in response to the wobbling of the wobble plate; a suction chamber for receiving a refrigerant gas to be supplied to the cylinder bores; a discharge chamber into which the refrigerant gas after compression is discharged from the cylinder bores; and a valve means arranged in a gas evacuation passageway extending between the crank chamber and the suction chamber—the valve means adjustably changing a pressure prevailing in the crank chamber to cause a change in the angle of inclination of the wobble plate, to thereby vary an amount of suction of the refrigerant gas into the cylinder bores. The above-mentioned valve means comprises a regulating valve capable of opening and closing the gas evacuation passageway, a pressure-responsive means connected to the regulating valve and controlling the operation of the regulating valve in response to a change in a pressure in the suction chamber, and an external control means connected to the pressure-responsive means and providing the pressure-responsive means with a load varying in response to an externally applied signal, to thereby adjustably change a reference pressure value of the pressure-responsive means. Namely, the reference pressure value of the pressure-responsive means can be freely changed by the external control means in such a manner that the pressure sensing characteristics of the pressure-responsive means are widely changed, and thus a large change in the operation characteristics of the regulating valve occurs. Accordingly, the above-mentioned valve means is able to adjust the pressure in the crank chamber at any level among a wide range of pressure levels, and therefore, the amount of stroke of the respective reciprocating pistons can be adjusted so that a desired compressor capacity-ranging from a very small to a very large capacity value, can be obtained. Consequently, it is possible to maintain a low evaporating temperature of the refrigerant gas and to reduce a cooling load applied to the compressor by lowering a capacity of the compressor.

Nevertheless, in the variable capacity wobble plate type compressor of the JP-A-63-16177, the valve means is arranged in the gas evacuation passageway communicating between the crank chamber and the suction chamber, and accordingly, a pressure rise in the crank chamber must be accomplished by a blowby gas leaking from the compression chambers in the cylinder bores during the compression stroke of the pistons. Accordingly, for example, when a car is to be rapidly accelerated, a pressure level in the crank chamber of the compressor must be quickly raised to rapidly change the operation of the compressor from a large to a smaller capacity, to lower a load applied to the car engine. When the valve means is closed, however, since the speed of raising the pressure level in the crank chamber is necessarily low, the compressor cannot quickly vary the capacity thereof, and therefore, a lowering of the load applied to the car engine is not achieved.

SUMMARY OF THE INVENTION

Therefore, an object of the present invention is to obviate the above-mentioned defects of the conventional variable capacity wobble type compressors.

Another object of the present invention is to provide a variable capacity wobble plate type compressor provided with a capacity regulating valve, capable of obtaining a desired compressor capacity from among a wide capacity range, i.e., from a very small capacity to a vary large capacity, in response to externally supplied signals, and having a high response speed for varying the compressor capacity.

A further object of the present invention is to provide a variable capacity wobble plate type compressor provided with a capacity regulating valve which comprises a pressure-responsive means capable of controlling a valve operation in response to a change in a suction pressure with respect to a reference value that is changeable in response to externally supplied signals.

In accordance with the present invention, there is provided a variable capacity wobble plate type compressor, which is adapted for use in an air-conditioning circuit of a car, and comprises:

a housing element having therein a suction chamber for a refrigerant gas before compression and a discharge chamber for a refrigerant gas after compression;

a cylinder block defining therein a plurality of cylinder bores arranged so as to surround an axial drive shaft and having therein associated reciprocatory pistons disposed so as to draw the refrigerant gas from the suction chamber and to then discharge the refrigerant gas after compression into the discharge chamber;

a crankcase having defined therein a chamber communicated with the cylinder bores and containing therein a drive plate mounted in such a manner that it is capable of rotating with the drive shaft as well as changing an inclination thereof with respect to the drive shaft and non-rotatably inclinable wobble plate held by the drive plate, to be capable of changing an inclination thereof with the drive plate in response to a difference between pressures in the chamber of the crankcase and in the suction chamber;

a plurality of connecting rods connected between the wobble plate and the pistons;

a gas supply passageway means for fluidly communicating said chamber of said crankcase with the discharge chamber of the housing element, to thereby supply the chamber of the crankcase with the refrigerant gas from the discharge chamber;

a gas evacuation passageway means for fluidly communicating the chamber of the crankcase with the suction chamber of the housing element, to thereby permit an evacuation of the refrigerant gas from the chamber of the crankcase to the suction chamber;

a capacity regulating valve means for controlling the supply of the refrigerant gas from the discharge chamber to the chamber of the crankcase, the capacity regulating valve means comprising a casing, a regulating valve element arranged in the gas supply passageway means for regulating a communication between the discharge chamber and the chamber of the crankcase via the gas supply passageway, and a pressure sensing means connected to the regulating valve element for moving the regulating valve element in response to a change in one of the pressures in the suction chamber, the discharge chamber, and the chamber of the crankcase with respect to a given set pressure; and an external force applying means connected to the pressure sensing means of the capacity regulating valve means to apply an external force to the pressure sensing means in response to an externally provided signal, to thereby adjust the given set pressure of the pressure sensing means.

BRIEF DESCRIPTION OF THE DRAWINGS

The above and other objects, features, and advantages of the present invention will become more apparent from the ensuing description of the embodiments of the present invention, taken in conjunction with the accompanying drawings, wherein.

DESCRIPTION OF THE PREFERRED EMBODIMENTS

Figure 1:
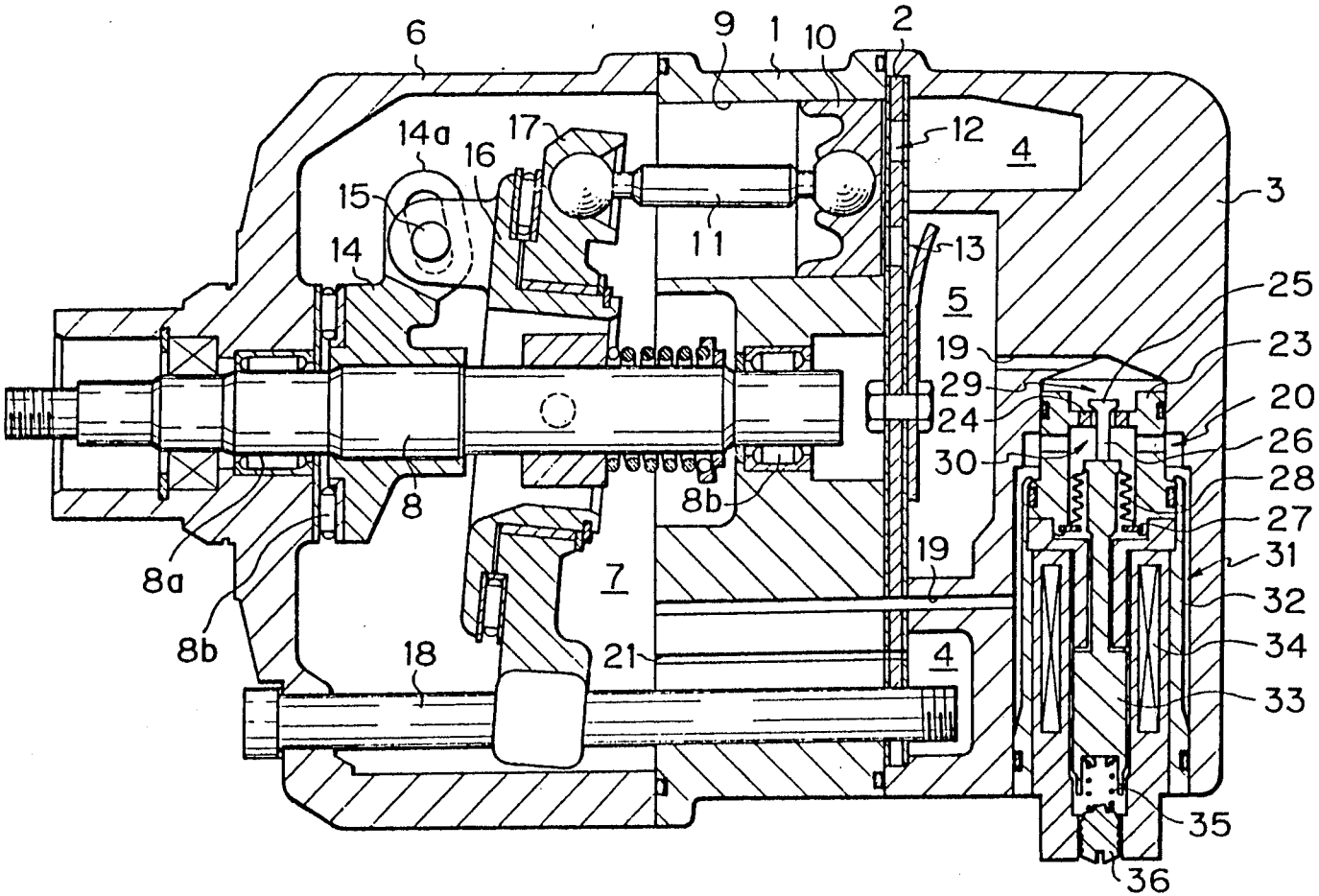
FIG. 1 is a longitudinal cross-sectional view of a variable capacity wobble plate type compressor with a capacity regulating valve according to a first embodiment of the present invention.

It should be understood that, throughout the drawings illustrating various embodiments, the same or corresponding elements or parts are designated by the same reference numerals.

Referring to FIG. 1, a rear housing 3 is secured through a valve plate 2 to the right end face of a cylinder block 1, and a substantially annular suction chamber 4 and a discharge chamber 5 are formed along the inner circumference and in the central section, respectively, of the rear housing 3. The suction chamber 4 and the discharge chamber 5 are connected through a suction port (not shown) and a discharge port (not shown), respectively, to an external cooling circuit. A front housing or a crankcase 6 in the shape of a bell-jar is secured to the left end face of the cylinder block 1 to define a crankcase chamber 7 therein, and a drive shaft 8, which is driven for rotation by an engine (not shown), is journaled on the cylinder block 1 and the front housing 6.

A plurality of cylinder bores 9 (only one shown) are formed through cylinder block 1 with the axes thereof in parallel with the drive shaft 8. A piston 10 is fitted for reciprocatory sliding motion in each cylinder bore 9, and a connecting rod 11 is connected at one end thereof to the left end of the piston 10 via a ball socket joint.

Suction valve mechanisms 12 are formed in the valve plate 2 to permit the flow of a refrigerant gas into the compression chamber of the corresponding cylinder bore 9, and discharge valve mechanisms 13 are also formed in the valve plate 2 to permit the discharge of the refrigerant gas compressed in the compression chamber of the corresponding cylinder bore 9 into the discharge chamber 5.

A drive element 14 is fixedly mounted on the drive shaft 8, and an inclinable or tiltable drive plate 16 is interlocked with the drive element 14, for rotation together with the drive element 14, by a connecting pin 15 fitted in an elongated slot formed in a lug 14*a* projecting from the drive element 14.

A wobble plate 17 is supported on the drive plate 16, to wobble together with the drive plate 16, and is restrained from rotation by a guide rod 18 extended at a fixed position. The connecting rods 11 are connected at the respective left ends thereof to the wobble plate 17 via respective ball and socket joints, and accordingly, when the drive element 14 is rotated by the drive shaft 8, the wobble plate 17 wobbles to drive the pistons 10 through the connecting rods 11 for reciprocatory motion. The stroke of the piston 10 is dependent on the pressure difference $\Delta p = Pc - Ps$, where Pc is the pressure in the crankcase chamber 7 and Ps is the pressure in the suction chamber 4. Namely, the stroke of the piston 10 is shortened and the wobble angle of the wobble plate 17 is reduced, to reduce the compression capacity, as the pressure difference $\Delta p$ is increased, and the stroke of the piston 10 is lengthened and the wobble angle of the wobble plate 17 is widened, to increase the compression capacity, as the pressure difference $\Delta p$ is decreased.

The constitution of the variable capacity wobble plate type compressor described above is the same as that of the conventional variable capacity compressor.

A gas supply passageway 19 is formed through the rear housing 3, the valve plate 2 and the cylinder block 1, to introduce the compressed refrigerant gas into the crankcase chamber 7 from the discharge chamber 5, and a capacity regulating valve 20, described hereinafter, is provided in the gas supply passageway 19. To return the refrigerant gas leaked from the compression chamber of the cylinder bore 9 into the crankcase chamber 7 due to blowby, or the refrigerant gas supplied from the discharge chamber 5 to the crankcase chamber through the above-mentioned gas supply passageway 19 from the crankcase chamber 7 to the suction chamber 4, a gas evacuation passageway 21 is formed through the cylinder block 1 and the valve plate 2.

Figure 2:
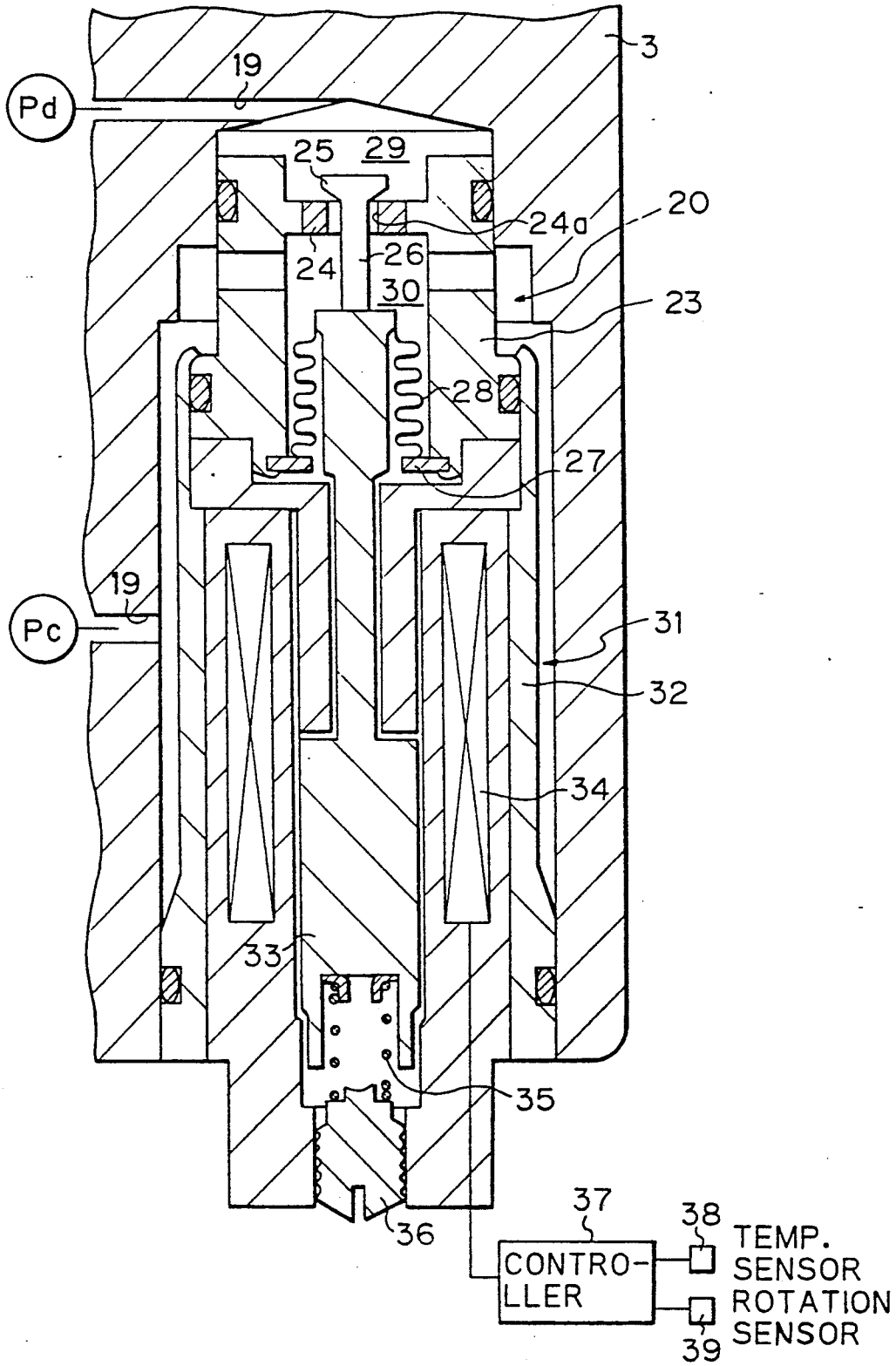
FIG. 2 is an enlarged cross-sectional view of the capacity regulating valve accommodated in the rear housing of the compressor of FIG. 1.

The capacity regulating valve 20 will be described with reference to FIG. 2. A cylindrical hollow valve housing 23 is tightly and sealingly fitted into a bore of the rear housing 3 to be arranged at a position approximately halfway along the gas supply passageway 19 extending from the discharge chamber 5 to the crankcase chamber 7. The cylindrical valve housing 23 is provided with a valve seat 24 formed therein whereby a valve port 24*a* is opened and closed by a valve element 25 which is moved toward and away from the valve seat 24. The valve element 25 operable as a flow regulating valve is one end of a support rod 26 extending axially through the valve port 24*a*. A mounting ring element 27 is fitted in a recess formed in the lower end of the cylindrical valve housing 23, and a bellows 28 is sealingly attached, at the lowermost end thereof, to the mounting ring element 27. The upper end of the bellows 28 is sealingly attached to an upper position of the support rod 26 of the valve element 25. Namely, the bellows 28 is provided as a pressure sensing element.

A high pressure chamber 29 for receiving the valve element 25 therein is defined by the cylindrical valve housing 23 and the bore wall of the rear housing 3, and communicated with the discharge chamber 5 via a part of the gas supply passageway 19 upstream of the valve element 25. A pressure-sensitive chamber 30 defined between a cylindrical inner wall of the cylindrical valve housing 23 and the outer surface of the bellows 28 is arranged beneath the valve seat 24, and communicated with the crankcase chamber 7 via the other part of the gas supply passageway 19 downstream of the valve element 25. The support rod 26 of the valve element 25 is connected to a magnetic movable core 33 of an electrically energizable solenoid 31 provided as an external control means and operable in response to externally supplied signals.

The solenoid 31 is described below with reference to FIG. 2.

A solenoid housing 32 for receiving a solenoid 31 is sealingly fitted in the bore of the rear housing 3, to be located under and connected to the cylindrical valve housing 23. The above-mentioned magnetic movable core 33 connected to the lowermost end of the support rod 26 is housed inside the solenoid housing 32, and is axially extendable. A stationary coil element 34 is also housed in the solenoid housing 32, to surround the movable core 33. The movable core 33 of the solenoid 31 is always resiliently biased by a biasing spring 35 positioned between the lower end of the movable core 33 and an upper end of an adjusting screw 36 threadedly engaged in the lowermost end of the solenoid housing 32. The biasing spring 35 applies a constant biasing force to the magnetic movable core 33, to thereby urge the valve element 25 via the support rod 26 toward a position away from the valve seat 24, i.e., an open position of the valve element 25. The adjusting screw 36 is manually screwed into and out of the solenoid housing 32 to adjust an initial force of the biasing spring 35.

The coil element 34 is electrically connected, via electric leads, to a controller 37, to which a temperature sensor 38 for detecting a temperature of, for example, a compartment of a car which temperature is proportional to a cooling load applied to the refrigerating circuit and the compressor is connected. Alternatively, a rotation sensor 39 detecting a number of rotations of the compressor may be connected to the controller 37.

The coil element 34 of the solenoid 31 is supplied with an electric current for energization by the controller 37, as required, and the electro-magnetic force given to the magnetic core 33 by the coil element 34 depends on the intensity of the supplied electric current. When the coil element 34 is energized by the supply of the electric current, the magnetic core 33 and the support rod 26 are moved upward in FIG. 2 by an electro-magnetic force, to push the valve element 25 in a direction such that an extent of an opening of the valve port 24*a* is increased. Accordingly, it is possible to adjust a pushing force on the valve element 25 by controlling the electro-magnetic force acting on the magnetic core 33 through a control of the intensity of the electric current supplied from the controller 37 to the coil element 34 of the solenoid 31. When the pushing force on the valve element 25 by the solenoid 31 is adjusted by the solenoid 31, a starting position of the valve element 25 of the capacity regulating valve 20, from which position the valve element 25 is moved to increase or decrease an extent of the opening of the valve port 24a in reponse to a change in a pressure in the pressure sensing chamber 30, is accordingly changed.

The operation of the variable capacity wobble plate type compressor having the above-described construction will be described below.

In the initial stage of the operation of the compressor after starting, when a temperature of a car compartment to be cooled is high and a large cooling load is applied to the compressor, a suction pressure Ps and a pressure in the crankcase chamber 7 approximately proportional to the suction pressure Ps are relatively high, and accordingly, the valve element 25 of the capacity regulating valve 20 is urged toward the closing position thereof. Under this condition, the relationships among pressures acting on the valve element 25 are established as described below.

A pressing force $F_1$ urging the valve element 25 toward a position closing the valve port 24a, i.e., the closing position of the valve element 25, due to a discharge pressure Pd prevailing in the discharge chamber 29, is expressed by $A_1 \times Pd$, where $A_1$ is an area of the valve port 24a.

A pressing force $F_2$ also urging the valve element 25 toward the closing position thereof, due to a pressure Pc prevailing in the pressure sensing chamber 30, is expressed by $(A_2 - A_1)$ Pc, where $A_2$ is an effective pressure sensing area of the bellows 28 and Pc is a pressure prevailing in the crankcase chamber 7.

Therefore, a composite force consisting of the above-mentioned forces $F_1$ and $F_2$ acts to move the valve element 25 toward the closing position thereof.

On the other hand, a lifting force Fm due to an electro-magnetic force exerted by the solenoid 31, and a resilient lifting force Fb due to forces exerted by the spring 35 and the bellows 28, act to move the valve element 25 toward a position of opening the valve port 24a, i.e., an opening position of the valve element 25. Therefore, the valve element 25 is always controlled so as to be brought to a position at which the equations given below are established, if the weights of the valve element 25 and the support rod 26 are ignored.

$$\begin{aligned} F_1 + F_2 &= Fm + Fb, \text{ i.e., } (A_2 - A_1)\,Pc + A_1\,Pd \\ &= Fm + Fb \end{aligned}$$

In the latter equation, if $A_2$ is assumed to be much larger than $A_1$, i.e., $A_2 >> A_1$, it is understood that an effect of the discharge pressure Pd is small, and accordingly, a condition where $(A_2 \times Pc)$ is approximately equal to (Fm+Fb) is established (this condition will be hereinafter referred to as condition (1) ).

The resilient force Fb consisting of forces exerted by the spring 35 and the bellows 28 is always constant, and the pressing force Fm due to the electro-magnetic force exerted by the solenoid 31 is varied to be proportional to the square of an electric current Im supplied to the coil element 34. Therefore, the following equation is obtained.

$$Pc \propto Im^2$$

The above equation can be regarded as indicating the property of the capacity regulating valve 20.

Further, as a general understanding with respect to a variable capacity wobble plate type compressor, a pressure Pc in the crankcase chamber is approximately proportional to a suction pressure Ps in the suction chamber, and therefore, the capacity regulating valve 20 can have a property as indicated by the equation, $Ps \propto Im^2$.

When the above-mentioned condition (1) is established, if the Pc is large, the valve element 25 is subjected to the pressing force urging the element 25 toward the closing position thereof, which force is larger than the composite force (Fm+Fb) urging the element 25 to the opening position thereof. Accordingly, the valve element 25 is maintained at the closing position, and as a result, the gas supply passageway 19 is blocked to prevent a supply of a high pressure refrigerant gas from the discharge chamber 5 to the crankcase chamber 7, and consequently, the initial large capacity compressing operation of the compressor is continued.

After a continuation of the large capacity compressing operation of the compressor for a given time, the suction pressure Ps and the crankcase pressure Pc are gradually lowered in response to the progress of a refrigerating effect, and when the pressure Pc in the pressure sensing chamber 30 is lower than a predetermined pressure level, the composite force urging the element 25 to the opening position becomes larger than the force urging the element 25 toward the closing position. Therefore, the valve element 25 is moved to the opening position to permit a high pressure refrigerant gas to flow from the discharge chamber 5 to the crankcase chamber 7 via the gas supply passageway 19, and thus a pressure level in the crankcase chamber 7 is increased to generate a pressure difference $\Delta P$ between the pressures Pc and Ps of the crankcase and suction chambers 7 and 4. As a result, the reciprocating stroke of each piston 10 in each cylinder bore 9 is shortened to reduce the compression capacity of the compressor. Namely, the operation of the wobble plate type compressor is changed from a large capacity to a small capacity operation, and thus the operation of the variable capacity wobble plate type compressor is satisfactorily controlled by the capacity regulating valve 20 to respond to a change in a cooling load.

Nevertheless, when a particularly low evaporation temperature is needed, or conversely, when a small capacity compressing operation of the compressor is particularly needed, to reduce a load applied to a rotating source, i.e., a car engine, the electric energizing current Im supplied to the coil element 34 is adjusted by a controller 37, which is similar to a valve control circuit disclosed in the afore-mentioned U.S. Pat. No. 4,730,986, to adjust the force Fm exerted by the solenoid 31 so that an initial pressure level at which a change in the pressure Pc in the pressure sensing chamber 30 causes a controlled movement of the valve element 25 is changed.

On the other hand, when the compressor is operated at a large compressing capacity, if the rotating speed of the compressor is increased by a rapid acceleration of the car engine, a rotating sensor 39 detects a rapid change in the rotating speed of the compressor and generates a signal which is supplied to the controller 37. As a result, the electric energizing current Im supplied to the coil element 34 is increased by the controller 37, to thereby make the force Fm of the solenoid 31 large, and accordingly, the valve element 25 is immediately moved to the opening position thereof. Thus, a rapid supply of a high refrigerant gas from the discharge chamber 5 to the crankcase chamber 7 is effected, and therefore, the operation of the compressor is shifted to a small compressing capacity operation to thereby lower a load applied to the car engine.

Figure 3:
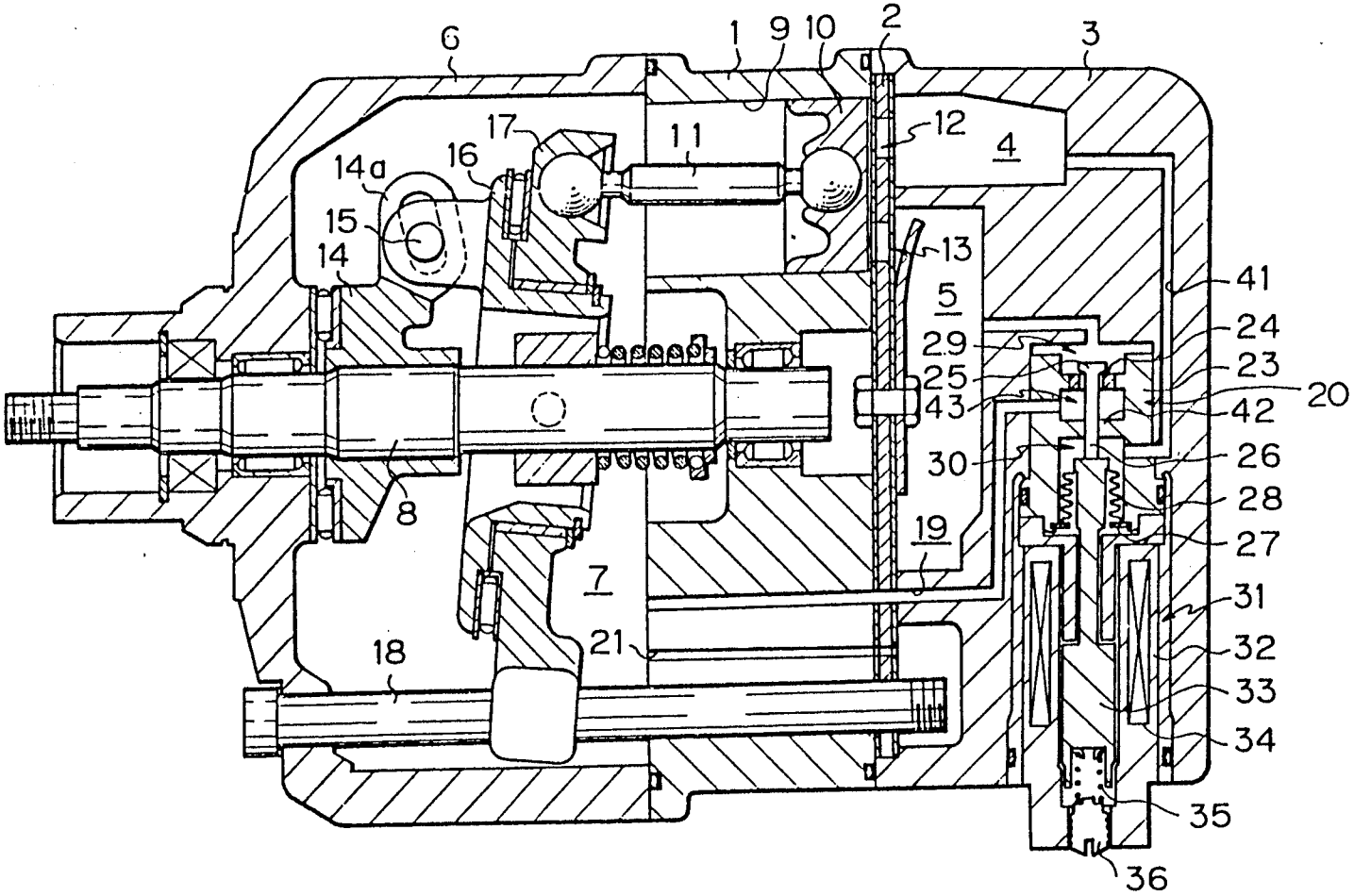
FIG. 3 is a longitudinal cross-sectional view of a variable capacity wobble plate type compressor with a capacity regulating valve according to a second embodiment of the present invention.
Figure 4:
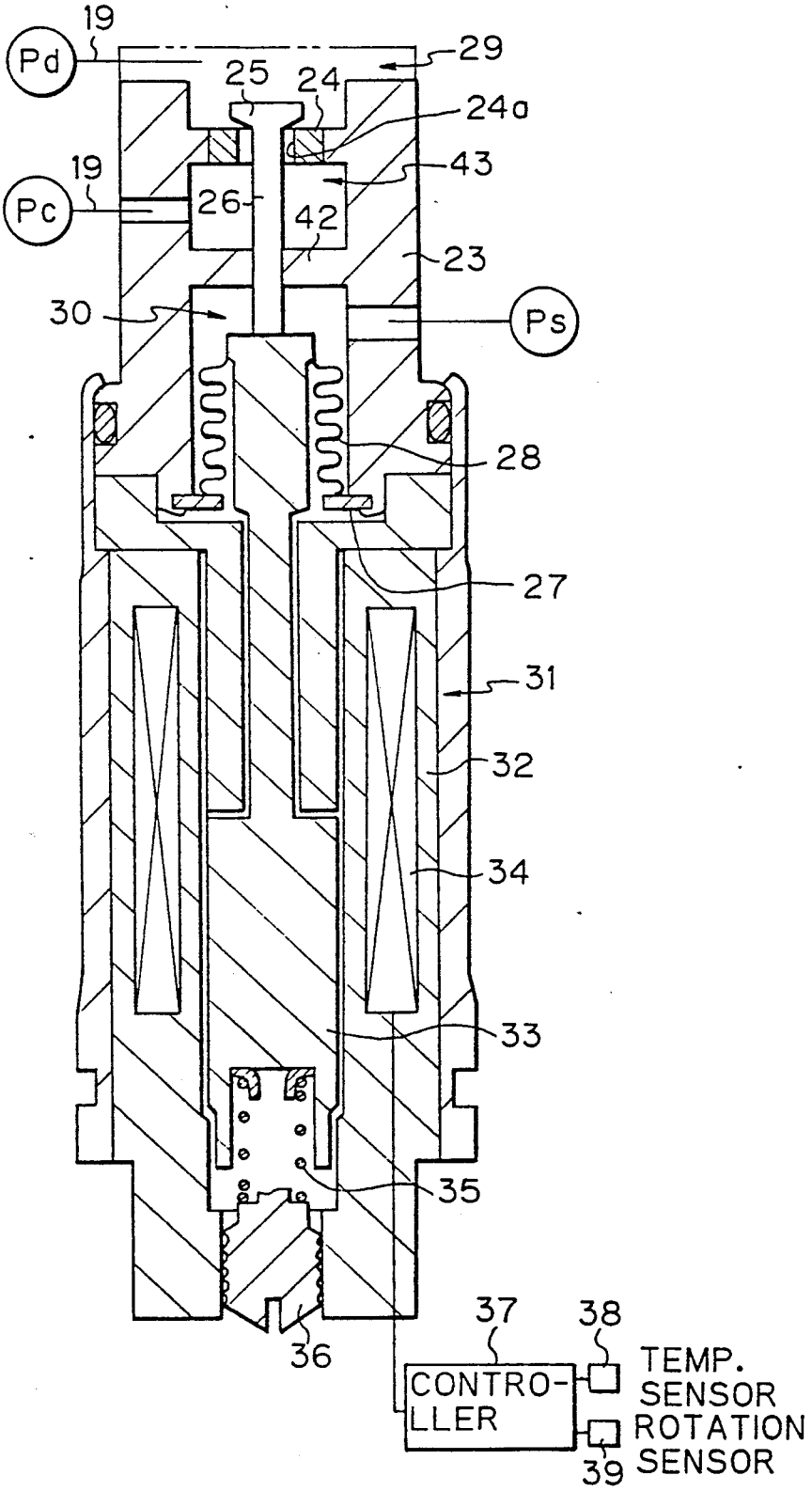
FIG. 4 is an enlarged cross-sectional view of the capacity regulating valve accommodated in the rear housing of the compressor of FIG. 3.

Referring to FIGS. 3 and 4, a variable capacity wobble type compressor includes a capacity regulating valve 20 according to a second embodiment of the present invention. The capacity regulating valve 20 is provided with a pressure sensing chamber 30 which is substantially the same as the pressure sensing chamber 30 of the first embodiment. The pressure sensing chamber 30 of the second embodiment, however, is, supplied with a suction pressure Ps by a pressure supply passageway 41 extending between a suction chamber 4 and the pressure sensing chamber 30. The capacity regulating valve 20 is also provided with an additional pressure sensing chamber 43 separated from the chamber 30 by a partition wall 42 formed to be integral with a cylindrical valve housing 23. A support rod 26 of a valve element 25 extends through the additional pressure sensing chamber 43, a central bore of the partition wall 42, and the pressure sensing chamber 30, and the additional pressure sensing chamber 43 is communicated with a crankcase chamber 7 via a gas supply passageway 19. Note, although no further description is given here, the construction of the capacity regulating valve 20 other than that described above is the same as that of the first embodiment.

In the second embodiment, as the suction pressure Ps varying in response to a change in a cooling load acts directly on the pressure sensing chamber 30, the responsitivity of the capacity regulating valve 20 of the second embodiment is increased compared with the valve 20 of the first embodiment employing the crankcase chamber pressure Pc acting on the pressure sensing chamber 30.

In the second embodiment, when the rotating speed of the compressor is rapidly increased due to a rapid acceleration of a car engine, a rapid reduction in the suction pressure Ps prevailing in the pressure sensing chamber 30 occurs. Accordingly, the valve element 25 is quickly moved to an opening position thereof without increasing the lifting force Fm by increasing the electric current Im, and therefore, the pressure Pc in the crankcase chamber 7 is quickly increased by the supply of a high pressure gas from a discharge chamber 5 to the crankcase chamber 7 via an opening valve port 24*a* and the gas supply passageway 19. As a result, the compressing capacity of the compressor can be rapidly reduced by shortening the piston stroke of each piston 10 in the cylinder bore 9, and thus a load applied to the car engine by the operation of the compressor can be reduced.

In the second embodiment, when an cross-sectional area of the valve support rod 26 is $A_3$, and if a relationship among the cross-sectional area $A_1$ of the valve port, the above-mentioned area $A_3$, and an effective pressure sensing area of a bellows 28 is established as shown below, $$A_3 >> A_1 > A_3$$

an equation, i.e., $A_2 \times Ps = Fm + Fb$, is established.

Namely, Ps is proportional to (Fm+Fb), and further, Fm is approximately equal to ($a \times Im^2$), where "a" is a constant of proportion.

Therefore, the suction pressure Ps is proportional to the square of the electric energizing current Im supplied to the coil element 34. Accordingly, when the electric current Im is controlled by a controller 37, to control the crankcase chamber pressure Pc and thereby regulate the compressing capacity of the compressor, the suction pressure Ps can be maintained at a desired value determined by the electric current Im controlled by a controller 37.

In the above-described first and second embodiments of FIGS. 1 through 4, the gas evacuation passageway 21 is arranged to be in constant communication with the crankcase chamber 7 and the suction chamber 4. Nevertheless, an appropriate control valve, such as the control valve disclosed in U.S. Pat. No. 4,702,677 to Takenaka et al and an electro-magnetic control valve disclosed in U.S. Pat. No. 4,730,986 to Kayukawa et al may be arranged in the gas evacuation passageway 21, to block the passageway when the gas supply is conducted via the gas supply passageway 19.

Figure 5:
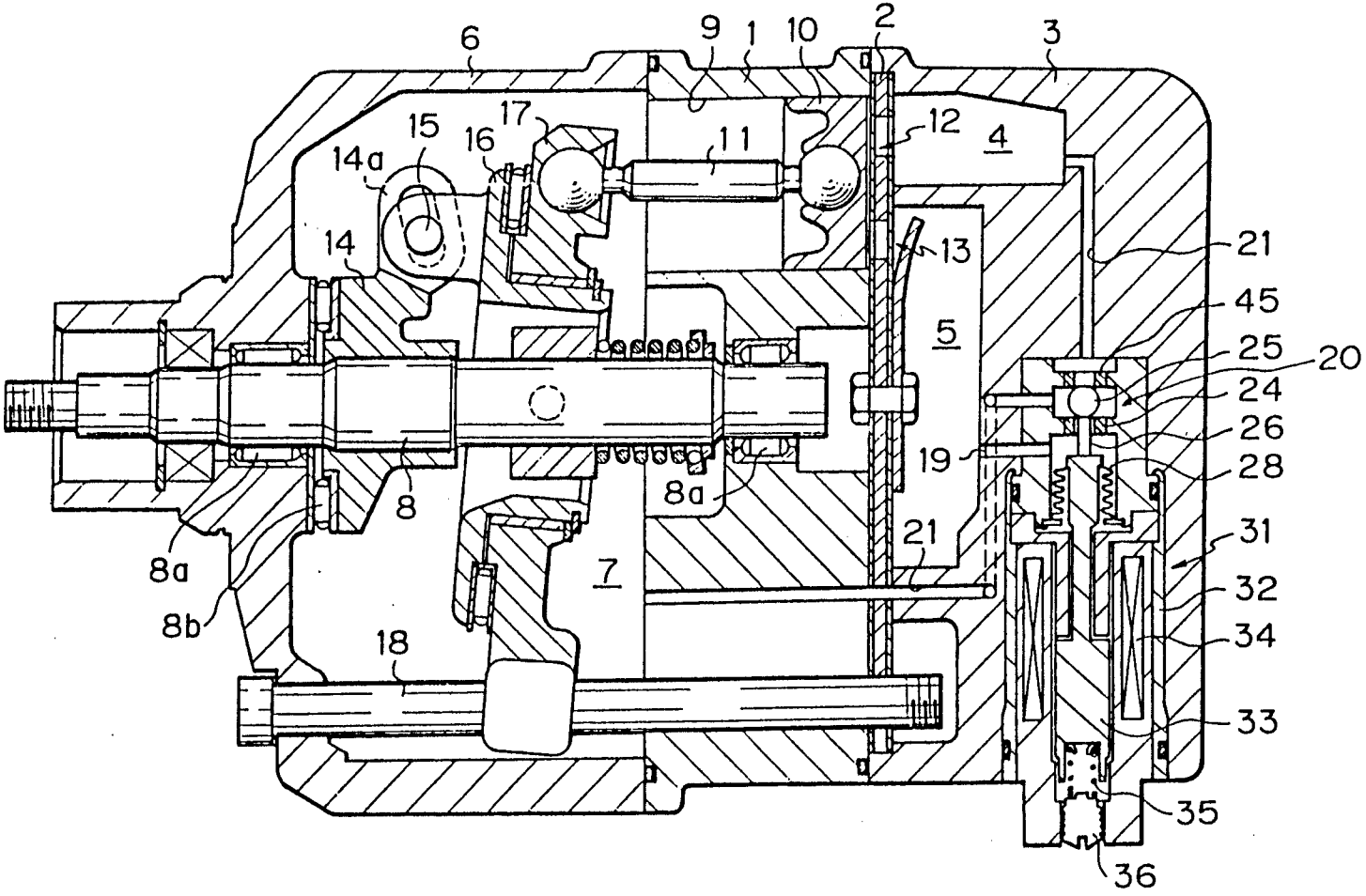
FIG. 5 is a longitudinal cross-sectional view of a variable capacity wobble plate type compressor with a capacity regulating valve according to a third embodiment of the present invention.
Figure 6:
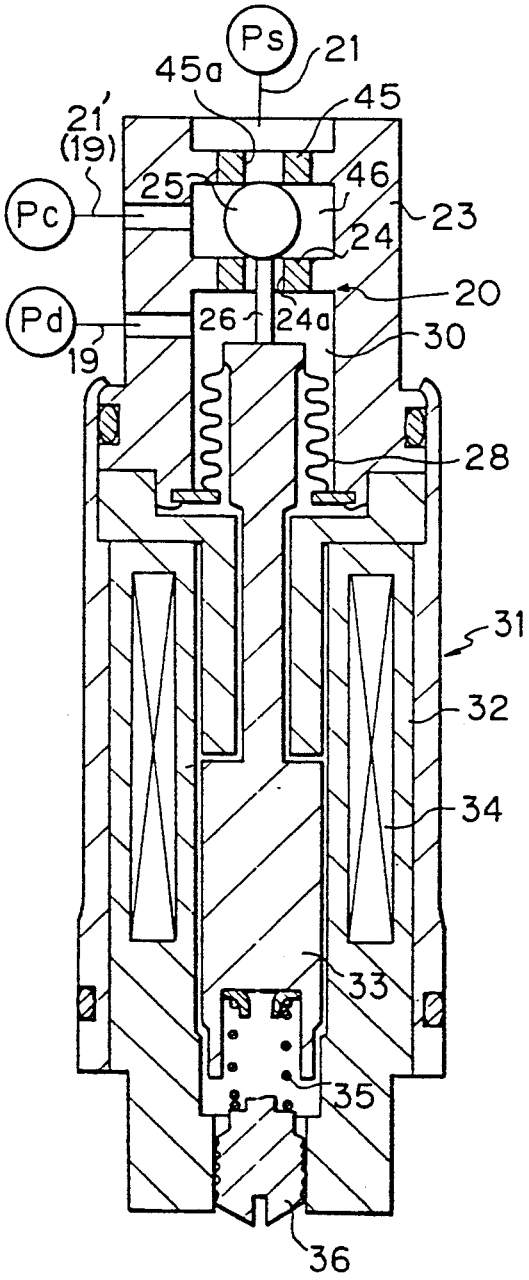
FIG. 6 is an enlarged cross-sectional view of the capacity regulating valve accommodated in the rear housing of the compressor of FIG. 5; and, FIGS. 7 and 8 are partial enlarged views illustrating modifications of a part of the capacity regulating valve according to the present invention.

Referring to FIGS. 5 and 6 illustrating a third embodiment of the present invention, a capacity regulating valve 20 is provided with a ball-shaped valve element 25 supported by a support rod 26, to open or close a valve port 24*a* of a valve seat 24 of a cylindrical valve housing 23, and a pressure sensing chamber 30 surrounding a bellows 28 and directly communicated with a discharge chamber 5 via a gas supply passageway 19. The capacity regulating valve 20 is also provided with a valve seat 45 positioned above the valve seat 24, and has a valve port 45*a* communicated with a suction chamber 4 via a gas evacuation passageway 21 and opened or closed by the ball-shaped valve element 25. Namely, the valve element 25 commonly cooperates with the upper and lower valve ports 45*a* and 24*a*. The valve 20 is further provided with a pressure chamber 46 communicated with a crankcase chamber 7 via a passageway 21' (this passageway 21' can be a part of the gas supply passageway 19 when the valve port 24*a* is opened), and arranged between the valve seats 24 and 45. The pressure chamber 46 is able to be communicated with the gas evacuation passageway 21 during opening of the valve port 45*a*, and when the ball-shaped valve element 25 is moved to a position closing the valve port 45*a*, the valve port 24*a* of the valve seat 24 is left open to establish a communication between the discharge chamber 5 and the crankcase chamber 7 via the gas supply passageway 19.

In accordance with the capacity regulating valve 20 of the third embodiment, when a high pressure gas is supplied from the discharge chamber 5 to the crankcase chamber 7, the gas evacuation passageway 21 is firmly closed by the ball-shaped valve element 25. Therefore, a rapid raise in the pressure of the crankcase chamber 7 is ensured, and accordingly, a shift of the operation of the compressor from a large compressing capacity operation to a small compressing capacity operation can be quickly achieved. Namely, a good capacity regulating responsitivity can be obtained by the capacity regulating valve according to the third embodiment.

When the cross-sectional area of the valve port 45*a* is $A_4$, an equation below is established with regard to forces acting on the valve element 25.

$$A_4 \cdot Ps + (A_1 - A_4)Pc + (A_2 - A_1)Pd = Fm + Fb \quad (3)$$

From the above equation, three different properties (i) through (iii) of the capacity regulating valve 20 can be realized according to a relationship among $A_1$, $A_2$, and $A_4$.

(i) Where $A_4 = A_1 = A_2$ is established:

The above equation (3) can be changed to the following equation (4), $$A_4 \times Ps = Fm + Fb \quad (4)$$

and a result, the property of Ps $\propto$ Im$^2$ can be obtained.

In the refrigerating circuit, an evaporating temperature of an evaporator is determined by the suction pressure Ps, and accordingly, the cooling performance of the refrigerating circuit can be easily controlled by controlling the electric energizing current Im supplied to a coil element 34 of a solenoid 31.

The control operation of the compressor capacity will be briefly described hereinbelow.

When the compressor is under usual operation conditions such that the suction pressure Ps is equal to $Ps_0$, the above equation (4) must be satified.

Namely, $A_4 \times Ps_0 = Fm + Fb$.

When either a cooling load is increased or a rotating speed of the compressor is reduced, to increase the suction pressure $Ps_0$ to $Ps_1$ during the abovementioned operating condition of the compressor, an unequal equation as shown below is established.

Namely, $A_4 \cdot Ps > Fm + Fb$

Therefore, the communication between the crankcase chamber 7 and the discharge chamber 5 via the gas supply passageway 19 is interrupted by the closing of the valve port 24*a*, and the valve port 45*a* connected to the gas evacuation passageway 21 is opened. Accordingly, the pressure Pc in the crankcase chamber 7 is lowered to thereby increase the compressing capacity of the compressor. After the increase in the compressing capacity of the compressor, when the suction pressure $Ps_1$ is lowered, the gas supply passageway 19 becomes effective due to the opening of the valve port 24*a*, and the valve port 45*a* is closed to interrupt the communcation between the crankcase chamber 7 and the suction chamber 4 via the gas evacuation passageway 21, and accordingly, the compressing capacity of the compressor is reduced and the compressor is returned to the usual operating condition thereof.

(ii) Where $A_4 > A_1 = A_2$ is established:

The above equation (3) can be rewritten as follows.

$$A_4 \cdot Ps + (A_1 - A_4) Pc = Fm + Fb \quad (5)$$

This means that the capacity regulating valve 20 has a property in which a combined pressure of the suction and crankcase chamber pressures Ps and Pc is proportional to the electric energizing current Im of the coil element 34 of the solenoid 31.

The operation of the capacity regulating valve 20 in the above-mentioned case (ii) will be described below.

During a usual operation of the compressor, when the suction pressure Ps and the crankcase chamber pressure Pc are equal to $Ps_0$ and $Pc_0$, respectively, the equation (5) must be satisfied.

$$A_4 \cdot Ps_0 + (A_1 - A_4) Pc_0 = Fm + Fb \quad (6)$$

When the suction pressure Ps is increased from $Ps_0$ to $Ps_1$, due to either an increase in a cooling load or a decrease in the rotaing speed of the compressor, the crankcase chamber pressure Pc is accordingly increased from $Pc_0$ to $Pc_1$. Therefore, the condition of the equation (6) is changed to a different condition defined by an inequality set forth below.

$$A_4 \cdot Ps_0 + (A_1 - A_4) Pc_0 > Fm + Fb$$

Accordingly, the ball-shaped valve element 25 is moved to a position at which the valve port 24*a* is closed to block the gas supply passageway 19, and the valve port 45*a* is opened to provide a communication between the crankcase chamber 7 and the suction chamber 4 through the gas evacuation passageway 21. Consequently, the pressure Pc in the crankcase chamber 7 is reduced from $Pc_1$ to a lower pressure level while causing an increase in the compressing capacity.

During the operation of the compressor under such an increased compressing capacity, the suction pressure $Ps_1$ is gradually lowered, and a new usual operating condition of the compressor; defined by an equation below, is established.

$$A_4 \cdot Ps_2 + (A_1 - A_4) \cdot Pc_2 = Fm + Fb$$

, where $Ps_2$ is approximately equal to $Ps_0$, and $Pc_2$ is approximately equal to $Pc_0$.

The above case (ii) is different from the aforementioned case (i) in that the suction pressure Ps is not returned to the initial suction pressure $Ps_0$. Nevertheless, an advantage can be obtained from the case (ii) in that, in the afore-mentioned case (i), a lowering of the suction pressure Ps due to an increase in the compressor capacity occurs as a phenomenum in the refrigerating circuit including the compressor. This phenomenum is slow compared with the opening and closing operation of the valve element 25 and a change in the pressure Pc of the crankcase chamber 7, and therefore, hunting occurs. Nevertheless, in the case (ii), as the phenomenum of a quick change in the crankcase chamber pressure Pc and that of a slow change in the suction chamber pressure Ps occur in parallel with one another, no hunting occurs in the motion of the capacity regulating valve 20. Therefore, the capacity regulating valve 20 can stably operate to regulate the capacity of the compressor, although the accuracy of the proportional relationship Ps $\propto$ Im$^2$ might be sacrificially reduced.

(iii) Where $A_4 = A_1 < A_2$ is established:

The above-mentioned equation (3) can be changed to an equation (7) shown below.

$$A_4 \cdot Ps + (A_2 - A_1) \cdot Pd = Fm + Fb \quad (7)$$

Therefore, a property of the capacity regulating valve 20 is obtained in which a combined pressure of the suction and discharge chambers pressures Ps and Pd is proportional to a square of the electric current, i.e., Im$^2$.

The capacity regulating operation of the valve 20 will be described below.

When the compressor is under a usual operation condition such that the suction pressure Ps is $Ps_0$ and the discharge pressure Pd is $Pd_0$, the equation (7) above is expressed by an equation (8) shown below.

$$A_4 \cdot Ps_0 + (A_2 - A_1) \cdot Pd_0 = Fm + Fb \quad (8)$$

During the above usual operating condition of the compressor, when a cooling load is increased to increse the suction pressure Ps from $Ps_0$ to $Ps_1$, the discharge pressure Pd is also increased from $Pd_0$ to $Pd_1$.

Therefore, the condition defined by the equation (8) is changed to a condition defined by an inequality set forth below.

$$A_4 \cdot Ps_1 + (A_2 - A_1) \cdot Pd_1 > Fm + Fb$$

Accordingly, the gas supply passageway 19 is blocked by the closing of the valve port 24a by the ball-shaped valve element 25, and the gas evacuation passageway 21 effectively communicates with the crankcase chamber 7 and the suction chamber 4, and thus the pressure Pc in the crankcase chamber 7 is lowered to increase the compressing capacity of the compressor. The increase in the compressing capacity causes a lowering of the suction pressure $Ps_1$ to a lower pressure, as well as an increase in the discharge chamber pressure $Pd_1$ to a higher pressure, and a new usual operating condition of the compressor is established.

$$A_4 \cdot Ps_2 + (A_2 - A_1) \cdot Pd_2 = Fm + Fb;$$

where $Ps_2 < Ps_0$, and $Pd_2 > Pd_1$.

Namely, in accordance with an increase in a cooling load, the suction pressure Ps is changed to $Ps_2$, which is lower than the initial suction pressure $Ps_0$.

When a cooling load is large, the suction pressure Ps must be set to a considerably lower value. In this connection, in cases (i) and (ii), it is necessary to change the electric energizing current Im, and therefore, a load detecting device is needed when the compressor is to be automatically operated. Further, when a cooling load is large, the discharge pressure Pd usually becomes high. Nevertheless, in the above case (iii), it is possible to detect a cooling load applied to the compressor by detecting the discharge pressure Pd, and to automatically lower the suction chamber pressure Ps. Namely, when a preliminary electric current Im of the coil element 34 of the solenoid 31 is manually set, it is possible to automatically operate the compressor without the provision of a cooling load detecting device.

Figure 7:
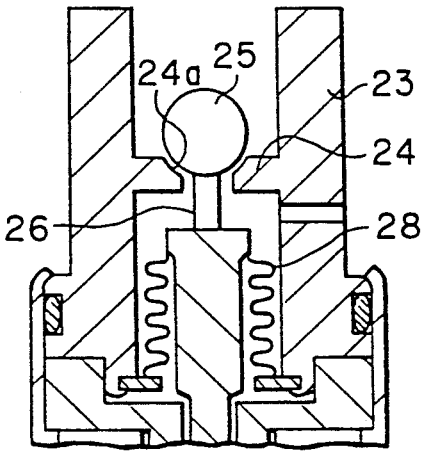
Figure 8:
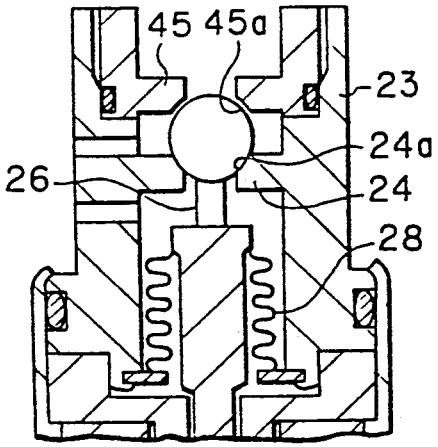

FIGS. 7 and 8 illustrate two modifications of the construction of the capacity regulating valve 20 of the first through third embodiments of FIGS. 1 through 6. Namely, in the embodiment of FIG. 7, the valve port 24a of the valve seat 24 is rounded so as to cooperate with a ball-shaped valve element 25. Further, in the embodiment of FIG. 8, the ball-shaped valve element 25 is moved between the opposed valve seats 24a and 45a, which are both rounded to prevent an abrasion thereof.

From the foregoing description of the first through three embodiments of the present invention it will be understood that, according to the present invention, a pressure sensing means is provided for regulating the opening and closing positions of a valve element of a capacity regulating valve, and that a set pressure value of the pressure sensing means is easily adjusted by an external control means, i.e., a solenoid means provided with a magnetic movable core. Accordingly, a difference between the suction pressure and the pressure in the crankcase chamber can be widely changed to comply with a demand for adjusting a compressing capacity, and therefore, it is possible to lower the capacity of the compressor to thereby lower a load applied to a car engine. Further, when a car speed is quickly accelerated, it is possible to quickly change the operation of the compressor to a lower compressing capacity operation thereof, to thereby reduce a load on the car engine.

Further, in one embodiment, when communication is established between the crankcase chamber and the discharge chamber via a gas supply passageway, a valve element is moved to a closing position to block a gas evacuation passageway and thereby quickly increase a pressure level in the crankcase chamber. Therefore, when a car engine is rapidly accelerated, so that the rotating speed of the compressor is increased, the operation of the compressor can be quickly changed from a large to a small capacity operation.

Note, various modifications to the present invention will occur to a person skilled in the art, without departing from the scope of the appended claims. For example, the bellows used as pressure sensing element of the described embodiments may be replaced with a conventional diaphgram.

We claim:

1. A variable capacity wobble plate type compressor adapted for use in an air-conditioning circuit of a car comprising:

a housing element having therein a suction chamber for a refrigerant gas before compression and a discharge chamber for a refrigerant gas after compression;

a cylinder block defining therein a plurality of cylinder bores arranged so as to surround an axial shaft and having therein associated reciprocatory pistons disposed so as to draw the refrigerant gas from the suction chamber and to then discharge the refrigerant gas after compression into the discharge chamber;

a crankcase having defined therein a drive plate mounted in such a manner that it is capable of rotating with the drive shaft as well as changing an inclination thereof with respect to the drive shaft and a non-rotatable inclinable wobble plate held by the drive plate in response to a difference between pressures in the chamber of the crankcase and the suction chamber;

a plurality of connecting rods connected between the wobble plate and the pistons;

a gas supply passageway means for fluidly communicating said chamber of said crankcase with said discharge chamber of said housing element to thereby supply said chamber of said crankcase with said refrigerant gas from said discharge chamber;

a gas evacuation passageway means for fluidly communicating said chamber of said crankcase with said suction chamber of said housing element to thereby permit an evacuation of said refrigerant gas from said chamber of said crankcase to said suction chamber;

a capacity regulating valve means for controlling the supply of said refrigerant gas from said discharge chamber to said chamber of said crankcase, said capacity regulating valve means comprising a casing, a regulating valve element arranged in said gas supply passageway means for regulating a communication between said discharge chamber and said chamber of said crankcase via said gas supply passageway, and a pressure sensing means connected to said regulating valve element for moving said regulating valve element in response to a change in one of pressures in said suction chamber, said discharge chamber, and said chamber of said crankcase with respect to a given set pressure, said regulating valve element comprising a valve element moved toward and away from a valve port of a valve seat fixedly arranged in a gas supply passageway means, and a valve support rod connecting said valve element to said pressure sensing means, said pressure sensing means being arranged in a pressure sensing chamber defined in said casing of said capacity regulating valve means and communicated with said discharge chamber and said valve element moved toward and away from said valve port of said valve seat being arranged to be moved toward and away from a different valve port of an additional valve seat fixedly arranged in said evacuation passageway means, said valve port and said different valve port being arranged to oppose one another along an axis of movement of said valve element whereby, when a valve port in said gas supply passageway means is opened by said valve element, another valve port in said gas evacuation passageway means is closed by said valve element; and an external force applying means connected to said pressure sensing means of said capacity regulating valve means to apply an external force to said pressure sensing means in response to an externally provided signal, to thereby variably adjust said given set pressure.

2. A variable capacity wobble plate type compressor according to claim 1, wherein said valve element comprises a ball-shaped valve element, and wherein said valve seat and said additional valve seat have a rounded valve port cooperable with said ball-shaped valve element.

* * * * *